US010332378B2

(12) United States Patent
Stolbikov et al.

(10) Patent No.: US 10,332,378 B2
(45) Date of Patent: Jun. 25, 2019

(54) DETERMINING USER RISK

(71) Applicant: LENOVO (Singapore) PTE. LTD., New Tech Park (SG)

(72) Inventors: Igor Stolbikov, Apex, NC (US); Timothy Winthrop Kingsbury, Cary, NC (US); Rod D. Waltermann, Rougemont, NC (US); Grigori Zaitsev, Durham, NC (US)

(73) Assignee: Lenovo (Singapore) PTE. LTD., New Tech Park (SG)

( * ) Notice: Subject to any disclaimer, the term of this patent is extended or adjusted under 35 U.S.C. 154(b) by 0 days.

(21) Appl. No.: 15/730,318

(22) Filed: Oct. 11, 2017

(65) Prior Publication Data

US 2019/0108742 A1 Apr. 11, 2019

(51) Int. Cl.

*G08B 19/00* (2006.01)
*G08B 21/04* (2006.01)
*G08B 25/01* (2006.01)

(52) U.S. Cl.

CPC ..... *G08B 21/0469* (2013.01); *G08B 19/00* (2013.01); *G08B 21/043* (2013.01); *G08B 21/0453* (2013.01); *G08B 25/016* (2013.01)

(58) Field of Classification Search

CPC ..... G06F 21/32; G06F 21/50; G06F 21/88; G06F 2221/2101; G06F 2221/2111; G06F 19/34; G06F 19/24; G06F 19/28; G06F 19/3418; G06F 21/40; G06F 21/45; G06F 2221/2103; G06F 2221/2117; G06F 17/277

USPC ..... 340/521, 991, 988, 989, 990, 5.82, 524, 340/529, 539.12, 539.14, 539.32, 426.22, 340/686.1, 5.81, 5.84

See application file for complete search history.

(56) References Cited

U.S. PATENT DOCUMENTS 9,199,122 B2 * 12/2015 Kaleal, III ..... A61B 5/4872
2008/0004793 A1 * 1/2008 Horvitz ..... G08G 1/01 701/487
2009/0289760 A1 * 11/2009 Murakami ..... G06K 9/00885 340/5.82

(Continued)

OTHER PUBLICATIONS

IBeat, Introducing the Smartwatch That Can Save Your Life, https://www.ibeat.com, known about as early as May 16, 2017 downloaded on Oct. 11, 2017, pp. 1-5.

(Continued)

*Primary Examiner* — Daniel Previl

(74) *Attorney, Agent, or Firm* — Kunzler Bean & Adamson

(57) ABSTRACT

For determining user risk using multiple data types, an apparatus is disclosed. A system, method, and program product also perform the functions of the apparatus. The apparatus for determining user risk using multiple data types includes a processor and a memory. The memory stores code executable by the processor. The processor receives first data about a user and determines a first probability of the user being at risk using the first data. In response to the first probability exceeding a first threshold, the processor receives second data, the second data being a different type of data than the first data. The processor also determines a second probability of the user being in danger using the second data. In response to the second probability exceeding a second threshold, the processor initiates an alarm.

20 Claims, 7 Drawing Sheets

(56) References Cited

U.S. PATENT DOCUMENTS

| | | | | |
|---|---|---|---|---|
| 2011/0125044 | A1* | 5/2011 | Rhee | A61B 5/113 600/534 |
| 2013/0198685 | A1* | 8/2013 | Bernini | G16H 40/63 715/800 |
| 2013/0212655 | A1* | 8/2013 | Hoyos | G06K 9/00107 726/5 |
| 2017/0146390 | A1* | 5/2017 | Kovacs | G01G 19/50 |

OTHER PUBLICATIONS

Consumer Reports, What to look for in a medical alert system, http://www.consumerreports.org/cro/2014/06/what-to-look-for-in-a-medical-alert-system/index.htm, updated in Jul. 2015, downloaded on May 8, 2017, pp. 1-4.

* cited by examiner

DETERMINING USER RISK

FIELD

The subject matter disclosed herein relates to audio output and more particularly relates to determining user risk using multiple data types.

BACKGROUND

In personal security, it is important to assess and identify the situation when personal security is impacted. Such situations include when a person is being mugged, assaulted, has sudden issues with his health and unable to breath. Existing phone solutions allow sending manual alerts to police or other registered parties in case of the dangerous situation. However, such solutions require a person to manually trigger alerts. This is almost impossible in the dangerous situations where person is unconscious or forced to defend herself, or when phone out of reach.

BRIEF SUMMARY

An apparatus for determining user risk using multiple data types is disclosed. A method and computer program product also perform the functions of the apparatus.

One apparatus for determining user risk using multiple data types includes a processor and a memory. The memory stores code executable by the processor. The processor receives first data about a user and determines a first probability of the user being at risk using the first data. The processor receives second data in response to the first probability of the user being at risk exceeding a first threshold, the second data being a different type of data than the first data. The processor also determines a second probability of the user being in danger using the second data and initiates an alarm in response to the second probability exceeding a second threshold.

In certain embodiments, the processor further stores the second data to a remote storage device in response to the second probability of the user exceeding the second threshold. In some embodiments, the processor further identifies a location of the user in response to the first probability exceeding a first threshold. Here, determining the second probability includes increasing the probability of the user being in danger in response to the user being located in a higher risk geographic area.

In some embodiments, receiving the first data includes receiving movement data of the user. Here, determining a first probability of the user being at risk using the first data includes calculating a degree to which a pattern of movement indicated by the movement data differs from a baseline pattern. In certain embodiments, receiving the first data includes receiving biometric data of the user. Here, determining a first probability of the user being at risk using the first data includes calculating whether the biometric data indicates a state of user stress.

In some embodiments, receiving the second data includes capturing audio data. Here, determining the second probability of the user being in danger includes analyzing the audio data to determine whether the user speaks a predetermined phrase. In certain embodiments, receiving the second data includes capturing image data. Here, determining the second probability of the user being in danger includes analyzing the image data for one or more of: an indication of a conflict, an indication of an injury, and an indication of damage. In some embodiments, initiating the alarm includes contacting one of: a predetermined contact and a predetermined device.

One method for determining user risk using multiple data types includes receiving, by use of a processor, first data about a user and determining a first probability of the user being at risk using the first data. The method also includes receiving second data in response to the first probability exceeding a first threshold, the second data being a different type of data than the first data. The method further includes determining a second probability of the user being in danger using the second data and initiating an alarm in response to the second probability exceeding a second threshold.

In certain embodiments, the method further includes storing the second data to a remote storage device in response to the second probability of the user being at risk exceeding the second threshold. In certain embodiments, the method further includes identifying a location of the user in response to the first probability exceeding a first threshold, wherein determining the second probability includes increasing the probability of the user being in danger in response to the user being located in a higher risk geographic area.

In some embodiments, receiving the first data includes receiving movement data of the user and determining a first probability of the user being at risk using the first data includes calculating a degree to which a pattern of movement indicated by the movement data differs from a baseline pattern. In such embodiments, receiving the first data further may also include receiving biometric data of the user. Here, determining the first probability of the user being at risk using the first data also includes calculating whether the biometric data indicates a state of user stress.

In some embodiments, receiving the second data includes capturing audio data and determining the second probability of the user being in danger includes analyzing the audio data to determine whether the user speaks a predetermined phrase. In such embodiments, receiving the second data further may also include capturing image data. Here, determining the second probability of the user being in danger also includes analyzing the audio data and the image data for one or more of: an indication of a conflict, an indication of an injury, and an indication of damage.

In some embodiments, initiating the alarm includes contacting one of: a predetermined contact and a predetermined device. In such embodiments, initiating the alarm further includes transmitting one or more of the second data and user location data to the predetermined contact or predetermined device.

One program product for determining user risk using multiple data types includes a computer readable storage medium that stores code executable by a processor. Here, the executable code includes code to: receive first data about a user; determine a first probability of the user being at risk using the first data; receive second data in response to the first probability of the user being at risk exceeding a first threshold, the second data being a different type of data than the first data; determine a second probability of the user being at risk using the second data; and initiate an alarm in response to the second probability of the user being at risk exceeding a second threshold.

In some embodiments, receiving the first data includes receiving one or more of: movement data of the user and biometric data of the user and receiving the second data includes receiving one or more of: video data, audio data, and location data. In certain embodiments, initiating the alarm includes sending the second data to one of: a predetermined contact and a predetermined device.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Figure 1:
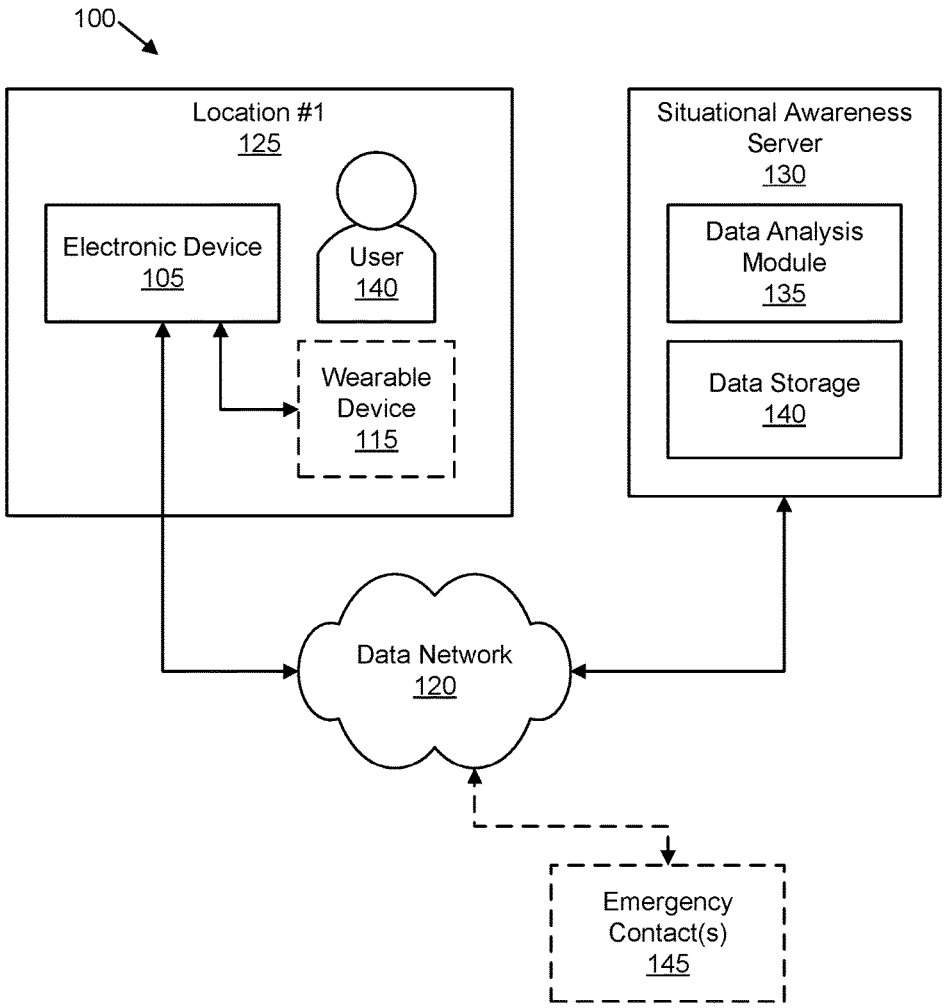
FIG. 1 is a schematic block diagram illustrating one embodiment of a system for determining user risk using multiple data types.

As will be appreciated by one skilled in the art, aspects of the embodiments may be embodied as a system, method, or program product. Accordingly, embodiments may take the form of an entirely hardware embodiment, an entirely software embodiment (including firmware, resident software, micro-code, etc.) or an embodiment combining software and hardware aspects that may all generally be referred to herein as a "circuit," "module," or "system." Furthermore, embodiments may take the form of a program product embodied in one or more computer readable storage devices storing machine readable code, computer readable code, and/or program code, referred hereafter as code. The storage devices may be tangible, non-transitory, and/or non-transmission. The storage devices may not embody signals. In a certain embodiment, the storage devices only employ signals for accessing code.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in code and/or software for execution by various types of processors. An identified module of code may, for instance, comprise one or more physical or logical blocks of executable code which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different computer readable storage devices. Where a module or portions of a module are implemented in software, the software portions are stored on one or more computer readable storage devices.

Any combination of one or more computer readable medium may be utilized. The computer readable medium may be a computer readable storage medium that is not a transitory signal. Said computer readable storage medium may be a storage device storing the code. The storage device may be, for example, but not limited to, an electronic storage device, magnetic storage device, optical storage device, electromagnetic storage device, infrared storage device, holographic storage device, micromechanical storage device, or semiconductor system, apparatus, or device, or any suitable combination of the foregoing.

More specific examples (a non-exhaustive list) of the storage device would include the following: an electrical connection having one or more wires, a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Code for carrying out operations for embodiments may be written in any combination of one or more programming languages including an object-oriented programming language such as Python, Ruby, Java, Smalltalk, C++, or the like, and conventional procedural programming languages, such as the "C" programming language, or the like, and/or machine languages such as assembly languages. The code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise.

The terms "including," "comprising," "having," and variations thereof mean "including but not limited to," unless expressly specified otherwise. An enumerated listing of items does not imply that any or all of the items are mutually exclusive, unless expressly specified otherwise. The terms "a," "an," and "the" also refer to "one or more" unless expressly specified otherwise.

Furthermore, the described features, structures, or characteristics of the embodiments may be combined in any suitable manner. In the following description, numerous specific details are provided, such as examples of programming, software modules, user selections, network transactions, database queries, database structures, hardware modules, hardware circuits, hardware chips, etc., to provide a thorough understanding of embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

Aspects of the embodiments are described below with reference to schematic flowchart diagrams and/or schematic block diagrams of methods, apparatuses, systems, and program products according to embodiments. It will be understood that each block of the schematic flowchart diagrams and/or schematic block diagrams, and combinations of blocks in the schematic flowchart diagrams and/or schematic block diagrams, can be implemented by code. These codes may be provided to a processor of a general-purpose computer, special-purpose computer, or other programmable data processing apparatus to produce a machine, such that the instructions, which execute via the processor of the computer or other programmable data processing apparatus, create means for implementing the functions/acts specified in the schematic flowchart diagrams and/or schematic block diagrams block or blocks.

The code may also be stored in a storage device that can direct a computer, other programmable data processing apparatus, or other devices to function in a particular manner, such that the instructions stored in the storage device produce an article of manufacture including instructions which implement the function/act specified in the schematic flowchart diagrams and/or schematic block diagrams block or blocks.

The code may also be loaded onto a computer, other programmable data processing apparatus, or other devices to cause a series of operational steps to be performed on the computer, other programmable apparatus, or other devices to produce a computer implemented process such that the code which execute on the computer or other programmable apparatus provide processes for implementing the functions/acts specified in the flowchart and/or block diagram block or blocks.

The schematic flowchart diagrams and/or schematic block diagrams in the Figures illustrate the architecture, functionality, and operation of possible implementations of apparatuses, systems, methods, and program products according to various embodiments. In this regard, each block in the schematic flowchart diagrams and/or schematic block diagrams may represent a module, segment, or portion of code, which comprises one or more executable instructions of the code for implementing the specified logical function(s).

It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated Figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and code.

The description of elements in each figure may refer to elements of proceeding figures. Like numbers refer to like elements in all figures, including alternate embodiments of like elements.

The present disclosure describes embodiments of systems, apparatuses, and methods for determining user risk using multiple data types. Generally, the disclosed embodiments leverage a first set of data sources to identify user risk. Once the user risk (expressed as a probability) exceeds a predetermined threshold, additional data is collected from a second set of data sources and use to determine whether the user is in danger. For example, a second probability may be calculated using data from the second set (e.g., aggregated together with the data from the first set) and the user determined to be in danger when the second probability exceeds a predetermined threshold.

In some embodiments, the first set of data sources include sensors that are constantly providing data to an electronic device. Examples of data sources in the first set include, but are not limited to, location sensors (e.g., using satellite positioning system and/or inertial measurement), motion sensors (e.g., accelerometers and/or gyroscopes), and biometric sensors (e.g., body temperature sensor, heart rate sensor, etc.). Here, these data sources are acquiring their data in the "background," rather than in response to user activity (e.g., the user running a specific application). In such embodiments, a monitoring device receives data from the first set of data sources and performs an analysis to calculate user risk (e.g., expressed as a percentage where high value indicates a high probability of the user being at risk and a low value indicates a low probability of the user being at risk).

In certain embodiments, the second set of data sources include sensors that typically do not constantly provide data to the electronic device. In other words, the data sources in the second set do not acquire the data in the "background." Rather, these sensors may be activated specifically in response to user activity (e.g., the user running a specific application). Accordingly, these sensors may be activated automatically in response to the user risk probability exceeding the threshold. Examples of data sources in the second set include, but are not limited to, microphones and other audio sensors, cameras and other image sensors, and the like. In certain embodiments, the monitoring device may receive data from an external device, such as a fitness tracker, step counter, wearable device, and the like.

In some embodiments, a particular data source may be included either the first set or second set based on device settings and user preferences. For example, a first device running a digital personal assistant may have the microphone constantly activated (e.g., "always-on") and may constantly monitor audio input for user prompt, while a second device not running a digital personal assistant only activates the microphone when the user is running a particular application, such as a voice recording application, telephone application, and the like. Here, the first device may categorize the microphone into the first set of data sources, while the second device may categorize the microphone into the second set of data sources. Further, at a later point in time a user of the second device may install a digital personal assistant causing the microphone to be constantly activated. At this point audio data may be constantly acquired, thereby re-categorizing the microphone into the first set of data sources.

In certain embodiments, a particular data source may be included in either the first set or second set based on power usage of the data source and/or based on computational requirements for analyzing the data. In some embodiments, additional analysis of data from the first set of data sources is implemented once the user risk probability exceeds the predetermined threshold. For example, additional computational models may be employed or more complex analysis performed. Moreover, data from both the first and second sets of data sources may be aggregated after the user risk probability exceeds the predetermined threshold in order to determine whether the user is actually in danger.

In response to the user being in danger, the monitoring device initiates an alarm response. Otherwise, if the user is not in danger, the monitoring device may continue to monitor the second set of data sources. The monitoring device may cease gathering and analyzing data from the second set of data sources if no danger is detected, e.g., after a certain amount of time or after the user risk probability drops below a certain threshold. At this point, the monitoring device continues to monitor the first data source and to update the user risk probability, but no longer processes data from the second set. In certain embodiments, the second set of data sources may be deactivated when not in use.

FIG. 1 depicts a system 100 for determining user risk using multiple data types, according to embodiments of the disclosure. The system 100 includes an electronic device 105 that is worn and/or carried by a user 110. In certain embodiments, the user 110 also wears a wearable device 115. As depicted, the user 110 is located at a first location 125. Here, the electronic device 105 may determine that the user 110 is located at the first location 125.

In some embodiments, the electronic device 105 communicates with the data network 120. Here, the electronic device 105 may communicate with a situational awareness server 130 and/or one or more emergency contacts 145. As depicted, the situational awareness server 130 may include an analysis module 135 and a data storage 140.

The electronic device 105 receives data and analyzes said data to determine whether the user 110 is at risk. When the probability that the user 110 is at risk exceeds a certain threshold, the electronic device 105 receives additional data (e.g., of additional data types) and then determines whether the user 110 is in danger (e.g., by calculating a second probability using the additional data). In one embodiment, the electronic device 105 gathers the second data, for example by requesting it from a data source and/or activating relevant sensors, drivers, or applications.

When the electronic device determines that the user 110 is in danger (e.g., because the second probability exceeds a threshold and/or analysis of the second danger provides evidence of significant threat, injury, or other danger), the electronic device 105 initiates one or more alarm responses. Alarm responses include, but are not limited to, communicating with one or more emergency contacts 145, gathering image and/or audio data usable as evidence for what occurred, uploading collected data to the data storage 140, outputting (e.g., via built-in speaker) an alarm sound, outputting (e.g., via built-in speaker) a request for aid, and the like. In certain embodiments, the electronic device 105 increases the probability of the user being in danger based on characteristics of the first location 125.

In certain embodiments, the electronic device 105 contacts the situational awareness server 130 when the probability that the users at risk exceeds the threshold. Here, the electronic device 105 may upload a data to be analyzed by the analysis module 135. The analysis module 135 analyzes the uploaded data and responds to electronic device 105 with one or more indicators of whether the user is in danger. Examples of analysis performed by the analysis module 135 include voice analysis to identify a speaker, speech recognition to identify a spoken phrase, image analysis to identify wounds, weapons, or other indicia of danger, and the like. In certain embodiments, uploaded data is stored at the data storage 140.

In some embodiments, the electronic device 105 is a user terminal device, such as a personal computer, terminal station, laptop computer, desktop computer, tablet computer, smart phone, personal digital assistant ("PDA"), and the like. In certain embodiments, the electronic device 105 may be a security device with personal security features. In certain embodiments, the electronic device 105 may be health monitor in communication with one or more medical providers.

The wearable device 115 is a device worn on or adjacent to the body of the user 110 may be used to provide the electronic device 105 with additional data to be analyzed when determining the probability of user risk and/or danger. The wearable device 115 is communicatively coupled to the electronic device 105, for example using wireless and/or wired communication links. In some embodiments, the wearable device 115 is a fitness tracker (e.g., activity tracker), a health/medical monitor, a smartwatch, a body temperature sensor, or similar. The wearable device 115 may be worn at or around a user's body part including, but not limited to the hand, wrist, arm, leg, ankle, foot, head, neck, chest, or waist.

Data gathered by the wearable device 115 may include, but is not limited to, body temperature, heart rate, brain activity, muscle motion, appendage motion (e.g., relative position, velocity, acceleration, and higher derivatives), sweat rate, step count, gross location (e.g., as measured by GPS or other satellite navigation system), and the like. Sensors included in the wearable device 115 may include, but are not limited to, one or more of: a temperature sensor, pressure sensor, accelerometer, altimeter, and the like. In certain embodiments, a wearable device 115 may include a display, a speaker, a haptic feedback device, or another user interface output. In certain embodiments, a wearable device 115 may include a microphone and/or camera.

The data network 120, in one embodiment, is a telecommunications network configured to facilitate electronic communications, for example between the electronic device 105 and the situational awareness server 130 and/or the emergency contacts 145. The data network 120 may be comprised of wired data links, wireless data links, and/or a combination of wired and wireless data links. Examples of wireless data networks include, but are not limited to, a wireless cellular network, a local wireless network, such as a Wi-Fi® network, a Bluetooth® network, a near-field communication ("NFC") network, an ad hoc network, and/or the like. In certain embodiments, the data network 120 forms a local area network ("LAN"), such as a wireless local area network ("WLAN").

In some embodiments, the data network 120 may include a wide area network ("WAN"), a storage area network ("SAN"), a LAN, an optical fiber network, the internet, or other digital communication network. In some embodiments, the data network 120 may include two or more networks. The data network 120 may include one or more servers, routers, switches, and/or other networking equipment. The data network 120 may also include computer readable storage media, such as a hard disk drive, an optical drive, non-volatile memory, random access memory ("RAM"), or the like.

Figure 2:
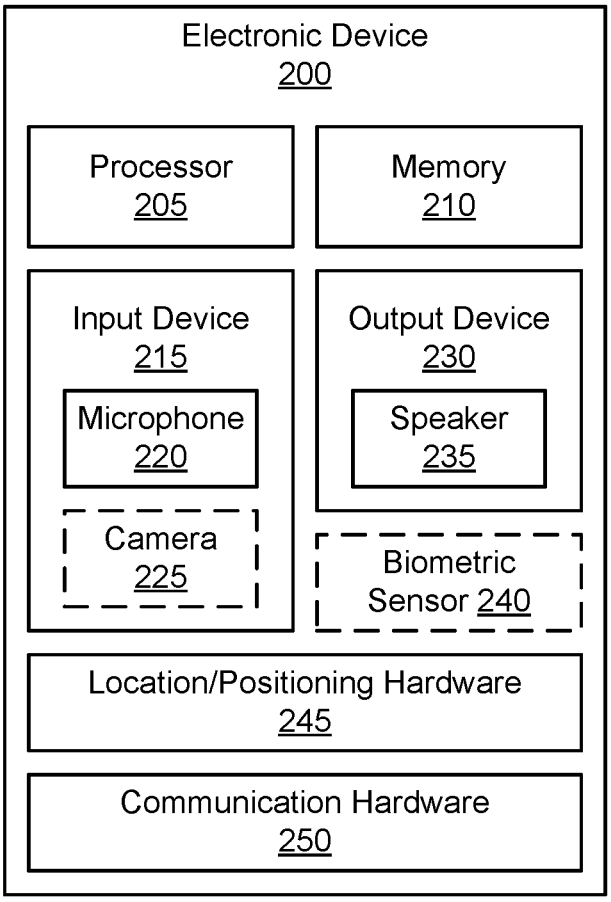
FIG. 2 is a schematic block diagram illustrating one embodiment of an apparatus for determining user risk using multiple data types.

FIG. 2 depicts a monitoring apparatus 200 for determining user risk using multiple data types, according to embodiments of the disclosure. The monitoring apparatus 200 may be one embodiment of the electronic device 105, described above. Alternatively, the monitoring apparatus 200 may be one embodiment of the analysis module 135. In some embodiments, the monitoring apparatus 200 is a wearable computing device, such as laptop computer, tablet computer, smart phone, smartwatch, personal digital assistant, and the like. The monitoring apparatus 200 includes a processor 205, a memory 210, an input device 215, an output device 230, location and positioning hardware 245, and communication hardware 250.

The processor 205, in one embodiment, may comprise any known controller capable of executing computer-readable instructions and/or capable of performing logical operations. For example, the processor 205 may be a microcontroller, a microprocessor, a central processing unit (CPU), a graphics processing unit (GPU), an auxiliary processing unit, a FPGA, an integrated circuit, or similar controller. In certain embodiments, the processor 205 may include multiple processing units, such as multiple processing cores, multiple CPUs, multiple microcontrollers, or the like. In some embodiments, the processor 205 executes instructions stored in the memory 210 to perform the methods and routines described herein. The processor 205 is communicatively coupled to the memory 210, input device 215, output device 230, and communication hardware 250.

In some embodiments, the processor 205 receives first data about a user and determines a first probability of the user being at risk using the first data. Examples of first data include, but are not limited to, movement data associated with the user, location data associated with the user, and biometric data from the user. In some embodiments, the processor 205 is continually receiving and processing the first data. In certain embodiments, the processor 205 may receive the movement, location, and/or biometric data for other applications, such as a fitness tracker application. Here, the processor 205 may monitor data collected on behalf of another application in order to intelligently evaluate a condition of the user, as described herein.

As discussed above, receiving the first data may include the processor 205 receiving movement data of the user and identifying a pattern of movement from the movement data. In some embodiments, the movement data includes location data, velocity data, acceleration data, derivatives of acceleration data (e.g., a rate of change in acceleration), step counter data, angular movement data, and the like. As used herein, a "pattern of movement" (also referred to herein as a "motion profile") refers to a pattern indicated by a plurality of data point from the movement data. The pattern of movement is characteristic of a type of movement (e.g., activity) performed or experienced by the user. Here, different activities are associated with different patterns or profiles. For example, running may have a different profile/pattern than walking, and each different than cycling. Accordingly, different user activities are identifiable from the movement data.

Moreover, determining the first probability of the user being at risk may include the processor 205 calculating a degree to which a pattern of movement indicated by the movement data differs from a baseline pattern. For example, movement that is a slight departure from a walking profile may not indicate a risk situation, but a radical departure from the walking profile (e.g., due to a fall or due to the user breaking into a sprint) may indicate a risk situation. Alternatively, determining the first probability of the user being at risk may include the processor 205 calculating a degree to which the identified pattern of movement matches a profile associated with danger or user risk, such a profile associated with falling, tripping, being pushed, etc. In certain embodiments, the processor 205 may determine a pattern of normal movement using the received movement data. In other embodiments, the processor 205 may use predefined profiles and patterns of movement. In further embodiments, the processor 205 may refine pre-stored templates to customize patterns of movement for the user.

In some embodiments, receiving the first data includes the processor 205 receiving biometric data belonging to the user. For example, the processor 205 may receive heart rate data, blood pressure data, skin temperature data, skin conductivity data, and the like. In certain embodiments, the biometric data is received from a wearable device, such as a fitness tracker, smart watch, and the like. Moreover, determining the first probability of the user being at risk may include the processor 205 calculating whether the biometric data indicates a state of user stress.

In some embodiments, the processor 205 uses one or more computational models to calculate the first probability that the user is at risk. For example, the first data is input into a computation model and the probability that the user is at risk (e.g., the first probability) is updated as the first data is input. Here, the computational model is continually updated with new data (e.g., new movement data and/or biometric data). The processor 205 evaluates whether the user is in a risk scenario (e.g., at significant risk of suffering injury or harm) based on whether the first probability falls within a particular range (e.g., exceeds a particular threshold).

If the first probability exceeds a first threshold, then the processor 205 receives (e.g., gathers) second data, the second data being a different type of data than the first data and re-determine the probability of the user being in danger using the second data (e.g., calculate a second probability). Here, the second data is usable to assess whether the user is in danger. In certain embodiments, collection and/or analysis of the second data may be more computationally intensive than that of the first data. Thus, the processor 205 may gather and analyze the second data only in response to the first probability exceeding a first threshold in order to conserve resources.

In determining the second probability that the user is in danger, the processor 205 may aggregate various types of data, including the first data and the second data, and makes the determination considering the aggregated data. Thus, the second data may be used to confirm or refute the initial determination of the user being at risk (represented by the first probability exceeding the first threshold). Moreover, the processor 205 may initiate a first response when the first probability exceeds the first threshold and may then escalate or deescalate the first response based on the second data.

In some embodiments, receiving the second data includes the processor 205 capturing audio data and determining the second probability of the user being in danger includes the processor 205 analyzing the audio data. In certain embodiments, the processor 205 perform speech analysis to discover is speech is present in the audio data and also to identify what is being spoken. For example, the processor 205 may determine whether the user (or another individual) speaks a predetermined phrase. The predetermined phrase may be associated with a dangerous situation (e.g., "Help me") or a non-dangerous situation (e.g., "I'm okay"). Further, the processor 205 may use voice recognition to determine if the user and/or a third party is speaking. Additionally, the processor 205 determine whether sounds of struggle or a conflict are present, if threatening words, phrases, or tones are used, and/or whether the audio data includes a call for help.

In some embodiments, receiving the second data includes the processor 205 capturing image data and determining the second probability of the user being in danger includes the processor 205 analyzing the image data for an indication of a conflict, an indication of an injury, and/or an indication of damage. If present, such an indication may increase the second probability that the user is in danger (e.g., to exceed a second threshold). Otherwise, the absence of such an indication may decrease the second probability.

In some embodiments, the processor 205 uses the same computational model when calculating the second probability as used to calculate the first probability. Here, the (various) second data are input into the computational model (and the first data updated as applicable) in order to determine the second probability. In other embodiments, the processor 205 may use a separate (different) computational module when calculating the second probability than used to calculate the first probability. Here, the first data and second data are input into the second computational model to determine the second probability.

In certain embodiments, the processor 205 also identifies a location of the user in response to the first probability exceeding a first threshold. Here, the location data may be collected with the second data. The location data is collecting in addition to other types of second data, such as audio data, video/image data, and the like. The location data may include satellite navigation data (such as data from a GPS receiver, GNSS receiver, GLONASS receiver, or the like). Additionally, the location data may include data of nearby wireless network, nearby cellular network cells, and the like.

Moreover, the processor 205 may identify a geographic area in which the user is located from the location data and also determine a risk level for the identified geographic area. In certain embodiments, the risk level may be specific to a particular type of danger. For example, a particular section of a hiking trail may be associated with higher levels of hiker injury than other sections of the trail. As another example, a particular area may be associated with higher levels of assault than other areas. The geographic area (and its risk level) is one factor to be considered when assessing whether the user is in trouble. Accordingly, when determining the second probability, the processor 205 may increase the probability of the user being in danger in response to the user being located in a higher risk geographic area. Moreover, the processor 205 may decrease the probability of the user being in danger in response to the user being located in a lower risk geographic area.

As will be apparent to one of skill in the art, the processor 205 may use a combination of the above approaches to determine the second probability. For example, the processor 205 may use audio data, location data, video/image data, movement data, and biometric data (or sub-combinations thereof) to determine the second probability of the user being in danger. In response to the second probability exceeding a second threshold, then the processor 205 initiates an alarm response. In certain embodiments, initiating the alarm includes calling or messaging a predetermined contact or device. For example, the processor 205 may call an emergency response (e.g., police or paramedic), a security service, a medical service, a family member, an "In Case of Emergency" (ICE) contact, or the like when the second probability exceeds the second threshold.

In some embodiments, the processor 205 stores the first data and/or the second data at a remote storage device in response to the second probability of the user being at risk exceeding the second threshold. For example, the first data and/or the second data may allow a responder to locate the user. As another example, the first data and/or the second data may include evidence usable to identify perpetrator of an attack, to identify witnesses, to identify a cause of injury, and the like. In certain embodiments, initiating the alarm includes outputting an alarm tone or signal from a speaker or other output device. Moreover, additional responses/services may be triggered in response to the second probability exceeding the second threshold.

The memory 210, in one embodiment, is a computer readable storage medium. In some embodiments, the memory 210 includes volatile computer storage media. For example, the memory 210 may include a random-access memory (RAM), including dynamic RAM (DRAM), synchronous dynamic RAM (SDRAM), and/or static RAM (SRAM). In some embodiments, the memory 210 includes non-volatile computer storage media. For example, the memory 210 may include a hard disk drive, a flash memory, or any other suitable non-volatile computer storage device. In some embodiments, the memory 210 includes both volatile and non-volatile computer storage media.

In some embodiments, the memory 210 stores data relating to outputting audio based on a user's location. For example, the memory 210 may store audible data, image data, movement data, biometric data, location data, movement profiles, contacts, responses, and the like. In some embodiments, the memory 210 also stores executable code and related data, such as an operating system or other controller algorithms operating on the monitoring apparatus 200.

The input device 215, in one embodiment, may comprise any known computer input device including a touch panel, a button, a keyboard, a microphone, a camera, and the like. For example, the input device 215 includes a microphone 220 or similar audio input device with which a user inputs audio data (e.g., audible commands). In some embodiments, the input device 215 may include a camera 225, or other imaging device, that captures image data. As described above, the image data may be used to associate an audible command with a particular user and/or to determine whether the particular user is located in a particular room. In some embodiments, the input device 215 comprises two or more different devices, such as the microphone 220 and a button.

The output device 230, in one embodiment, is configured to output visual, audible, and/or haptic signals. In some embodiments, the output device 230 includes an electronic display capable of outputting visual data to a user. For example, the output device 230 may include an LCD display, an LED display, an OLED display, a projector, or similar display device capable of outputting images, text, or the like to a user. In certain embodiments, the output device 230 includes one or more speakers 235 for producing sound, such as an audible alert/notification or streamed audio content. In some embodiments, the output device 230 includes one or more haptic devices for producing vibrations, motion, or other haptic output.

In some embodiments, all or portions of the output device 230 may be integrated with the input device 215. For example, the input device 215 and output device 230 may form a touchscreen or similar touch-sensitive display. As another example, the input device 215 and output device 230 may form a display that includes haptic response mechanisms. In other embodiments, the output device 230 may be located near the input device 215. For example, a camera 225, microphone 220, speaker 235, and touchscreen may all be located on a common surface of the monitoring apparatus 200. The output device 230 may receive instructions and/or data for output from the processor 205 and/or the communication hardware 250.

In certain embodiments, the electronic device 105 includes one or more biometric sensors 240 that gather biometric data regarding the user. Examples of biometric data include, but are not limited to, heart rate, body temperature, skin conductivity, muscle movement, sweat rate, brain activity, and the like. Moreover, the electronic device 105 may receive additional biometric data from an external device, such as the wearable device 115. Here, the additional biometric data may be received via the communication hardware 250.

The location and positioning hardware 245, in one embodiment, is configured to identify the location of the user. In certain embodiments, the location and positioning hardware 245 includes a satellite positioning receiver, such as a GPS receiver. Here, the location and positioning hardware 245 may determine a coordinate location of the user. Moreover, the processor 205 may identify a street address, neighborhood, region, or other geographic area associated with the identified coordinate location. In certain embodiments, the location and positioning hardware 245 includes multiple accelerometers and/or gyroscopes. Here, the location and positioning hardware 245 may gather inertial movement data to determine the user's location more precisely. Additionally, data from accelerometers and/or gyroscopes may be used to determine a body position of the user, such as upright, laying down, sitting, etc.

The communication hardware 250, in one embodiment, is configured to send and to receive electronic communications. The communication hardware 250 may communicate using wired and/or wireless communication links. In some embodiments, the communication hardware enables the monitoring apparatus 200 to communicate via the data network 120. The monitoring apparatus 200 may also include communication firmware or software, including drivers, protocol stacks, and the like, for sending/receiving the electronic communications.

In certain embodiments, the communication hardware 250 includes a wireless transceiver capable of exchanging information via electromagnetic radiation (e.g., communication via radio frequencies, infrared, visible light, and the like) or sound (e.g., ultrasonic communication). In one embodiment, the wireless transceiver acts as a wireless sensor for detecting wireless signals. As discussed above, the processor 205 may contact a third party, such as an in case of emergency ("ICE") contact, via the communication hardware 250 as a response to the second probability exceeding a danger threshold.

Figure 3:
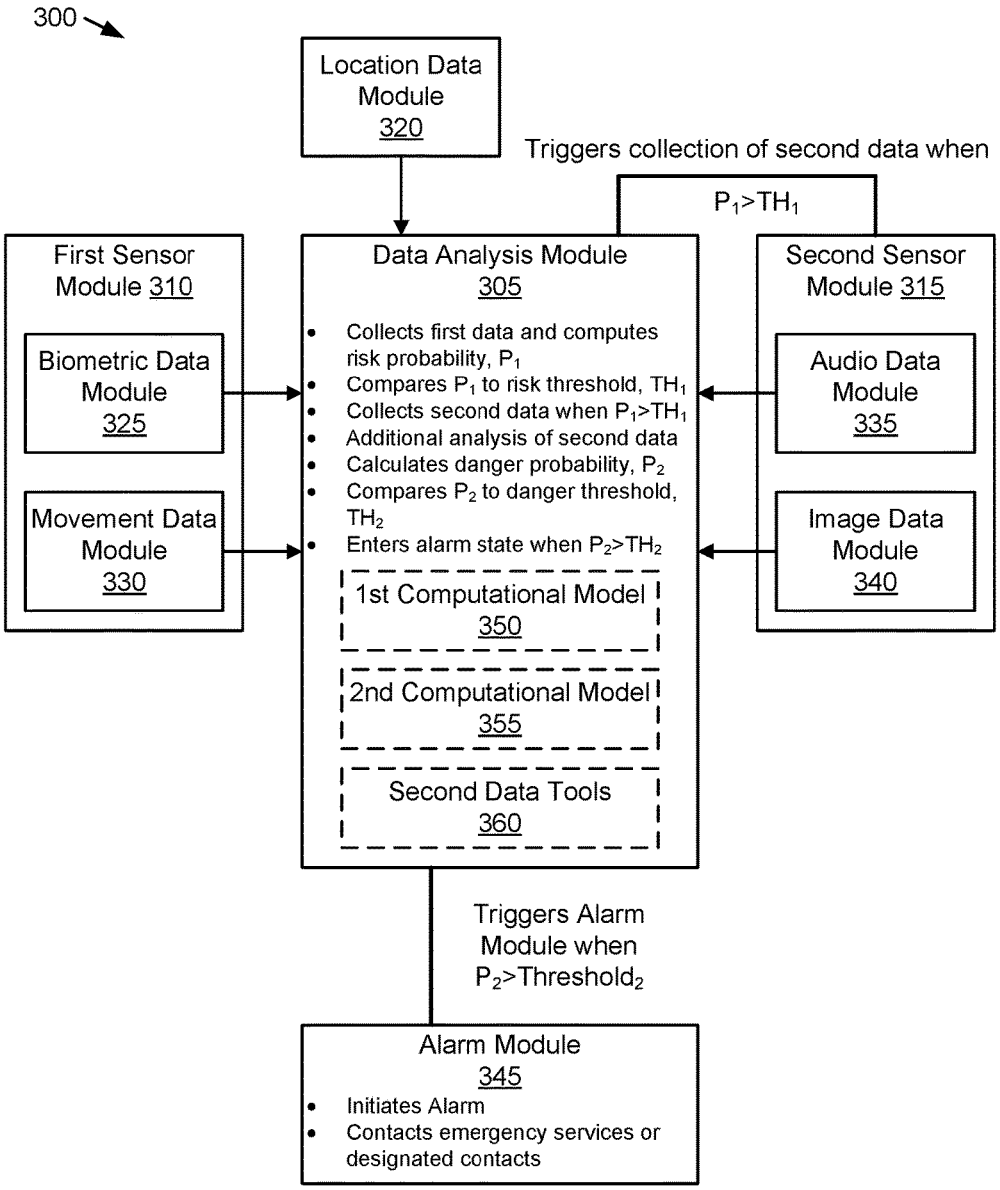
FIG. 3 is a block diagram illustrating one embodiment of selectively aggregating data of multiple types to determine user risk.

FIG. 3 depicts a risk assessment system 300 for determining user risk using multiple data types, according to embodiments of the disclosure. The risk assessment system 300 includes a data analysis module 305, a first sensor module 310, and a second sensor module 315. The data analysis module 305 collects data from the first sensor module 310 (said data referred to as "first data"). As depicted, the first sensor module 310 may include a biometric data module 325 and/or a movement data module 330.

Here, the biometric data module 325 generates biometric data. The biometric data module 325 is communicatively coupled to one or more sensors for generating the biometric data. Additionally, the movement data module 330 generates movement data, such as acceleration data, velocity data, relative location/orientation data, and the like. The movement data module 330 is communicatively coupled to one or more sensors for generating the movement data (e.g., accelerometer, gyroscope, or the like).

The data analysis module 305 computes a risk probability, $P_1$, using the first data. The risk probability corresponds to the likelihood of the user experiencing a risk situation, including but not limited to risk of injury, illness, danger, etc. In certain embodiments, the probability $P_1$ is calculated using a first computational module 350. The probability $P_1$ may be calculated using a window of data obtained over a predetermined time. In response to the risk probability, $P_1$, exceeding a risk threshold, $TH_1$, the data analysis module 305 begins to collect data from the second sensor module 315 (referred to as "second data"). As depicted, the second sensor module 315 may include an audio data module 335 and/or an image data module 340.

Here, the audio data module 335 provides audio data, for example acquired via a microphone. Additionally, the image data module 340 provides image data, for example acquired via a digital camera. The data analysis module 305 performs various analyses of the audio and/or image data to assess the user's situation more accurately. Based on the additional analysis, the data analysis module 305 calculates a second probability, $P_2$, corresponding to the likelihood of the user being in a dangerous situation. In certain embodiments, the probability $P_2$ is calculated using both the first data and the second data. The data analysis module 305 additionally compares the probability $P_2$ to a danger threshold, $TH_2$, and enters an alarm state when the second probability exceeds the danger threshold.

In certain embodiments, the data analysis module 305 uses a second computational module 355 to calculate the second probability ($P_2$). Here, second data, analysis results of the second data, first data, and the like are entered into the second computational module 355 which outputs the second probability. In one embodiment, output from the first computational module 350 is provided as input to the second computational module 355. In certain embodiments, the second data is analyzed using one or more second data tools prior to being input into the second computational module 355.

In some embodiments, the data analysis module 305 utilizes one or more second data tools 360 when analyzing the second data. Here, the second data tools 360 are advanced analysis techniques used analyze the audio and/or image data. For example, the second data tools 360 may include image recognition tools, speech recognition tools, voice analysis tools, and the like.

In one embodiment, the second data tools 360 include one or more routines to identify sounds of a struggle, fight, or conflict from the audio data. In another embodiment, the second data tools 360 include one or more routines to identify threats and/or a call for help from the audio data. In a third embodiment, the second data tools 360 include one or more routines to identify signs (or absence) of stress in the speech of the user (e.g., tone and/or pitch of voice, speech patterns, etc.).

In one embodiment, the second data tools 360 include one or more routines to identify visual evidence of injury, weapons, damage, and like from the image data. In another embodiment, the second data tools 360 include one or more routines to identify physiological indicators of stress from the image data.

In some embodiments, the risk assessment system 300 may include a location data module 320 that identifies the present location of the user. Here, the data analysis module 305 uses the location data to supplement its analysis of the user's situation. For example, if the user's present location corresponds to a high-risk geographic area, such as a spot of higher crime or higher accident rates, then the data analysis module 305 may calculate a higher likelihood of the user being in danger. As another example, if the user's path follows an unusual pattern, then the data analysis module 305 may calculate a higher likelihood of the user being in danger.

In some embodiments, the risk assessment system 300 includes an alarm module 345 that initiates one or more alarm responses when the second probability, $P_2$, exceeds the danger threshold, $TH_2$. The alarm responses may include, but are not limited to, producing an audible alarm, querying the user to confirm that they are in danger, contacting emergency services (e.g., police, medical services, etc.), calling a designated contact (e.g., an In-Case-of-Emergency contact), backing up data, and the like. Moreover, special security features and/or health features may be activated by the alarm module 345.

In certain embodiments, the data analysis module 305 is distributed, such that one level of analysis is performed at a local device and another level of analysis is performed at a remote location, such as the situational awareness server 130. For example, the user's device may begin sending data to a remote server for a more detailed analysis in response to the risk threshold being exceeded. In one embodiment, the user's device may upload second data to the remote server and receive analysis results in return. Here, the local device calculates the second probability using the analysis results (e.g., to supplement analysis performed at the local device). In another embodiment, the user's device may upload at least the second data to a remote server and receive the second probability in return.

Figure 4:
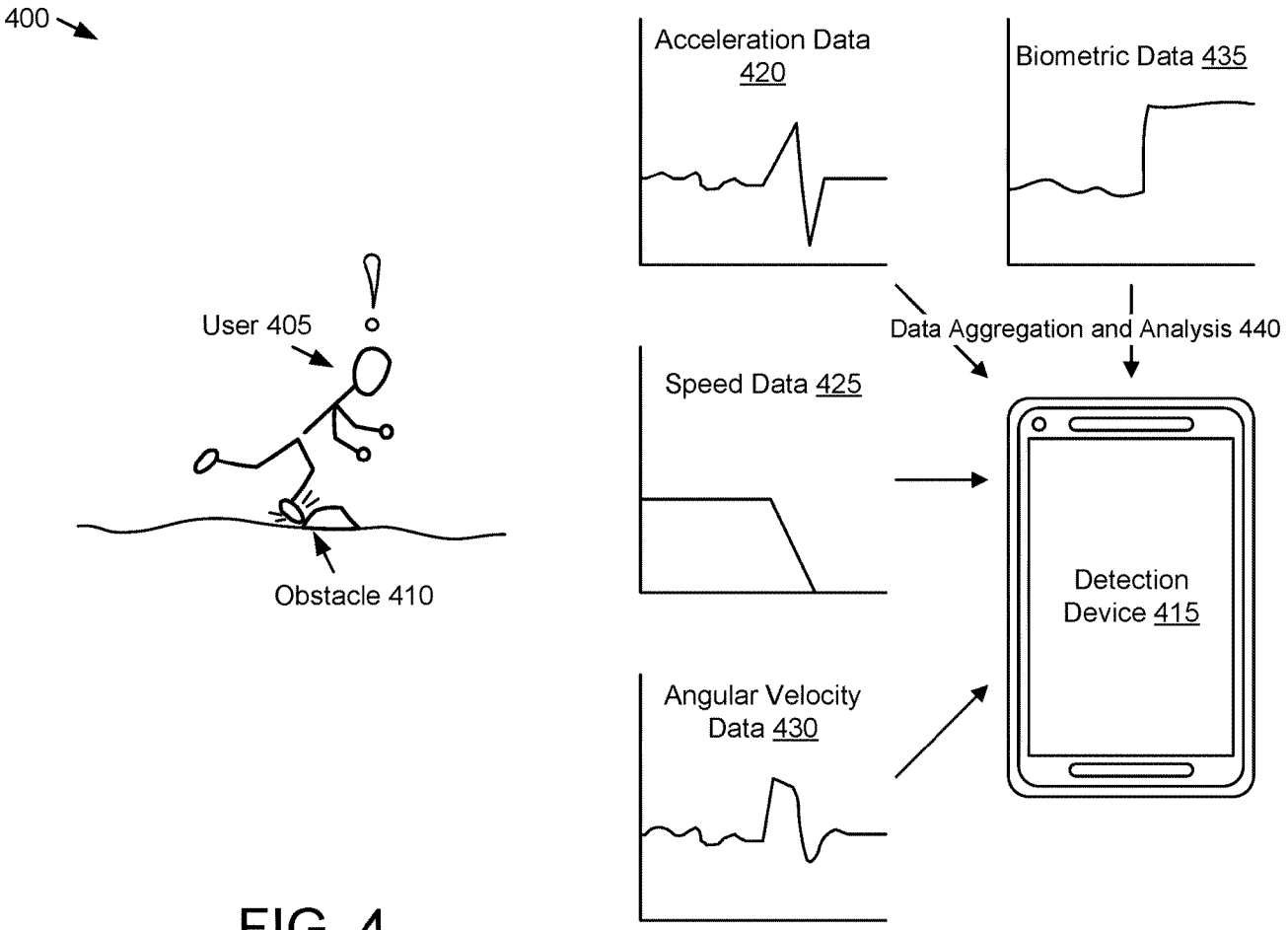
FIG. 4 is a schematic diagram illustrating one example of determining user risk using multiple data types.

FIG. 4 depicts a first situation 400 of determining user risk using multiple data types, according to embodiments of the disclosure. In the first situation 400, a user 405 is traveling and encounters an obstacle 410 which causes the user 405 to fall. A detection device 415 aggregates and analyzes various types of first data and detects the fall. Here, the various types of first data collected and analyzed by the detection device 415 include acceleration data 420, speed data 425, angular velocity data 430, and biometric data 435.

The detection device 415 combines signals from various sensors in order to build a composite image what the user 405 is experiencing. In certain embodiments, the detection device 415 matches subsets of the acceleration data 420, speed data 425, angular velocity data 430, and biometric data 435 to various profiles in order to build the composite image. Here, the various profiles may be categorized as normal or abnormal, with abnormal profiles indicating an increased risk of the user being in danger.

At the point in time when the user 405 encounters the obstacle 410, various of the first data (e.g., the acceleration data 420 and/or angular velocity data 430) indicate a disruption to the normal pattern of motion of the user 405, resulting from the user being pushed or falling. Moreover, the speed data 425 confirms disruption to the user's pattern of motion and the biometric data 435 indicates that the user 405 is experiencing increased stress after the point in time when the user 405 encounters the obstacle 410. Here, the detection device 415 identifies, e.g., in real time, the various indicia of the user falling to the ground, which increase the probability of the user being in danger (e.g., to exceed a threshold value). At this point, the detection device 415 triggers acquisition of second data (and corresponding analysis) used to identify the user's situation.

As discussed above, the detection device 415 may acquire and analyze second data including geolocation data, audio data, and/or video data. In certain embodiments, one or more analyses of the second data may be offloaded to a remote server. When the calculated probability of the person being in danger exceeds a certain threshold, the detection device 415 initiates one or more alarm responses, including automatic messaging of a designated contact, calling emergency services, etc. In one embodiment, the detection device 415 pick where the user 405 when the actuator probability exceeds the certain threshold. For example, the detection device 415 may ask "Are you in trouble?", "Do you need help?", or another phrase selected to verify that the user 405 requires assistance.

Figure 5:
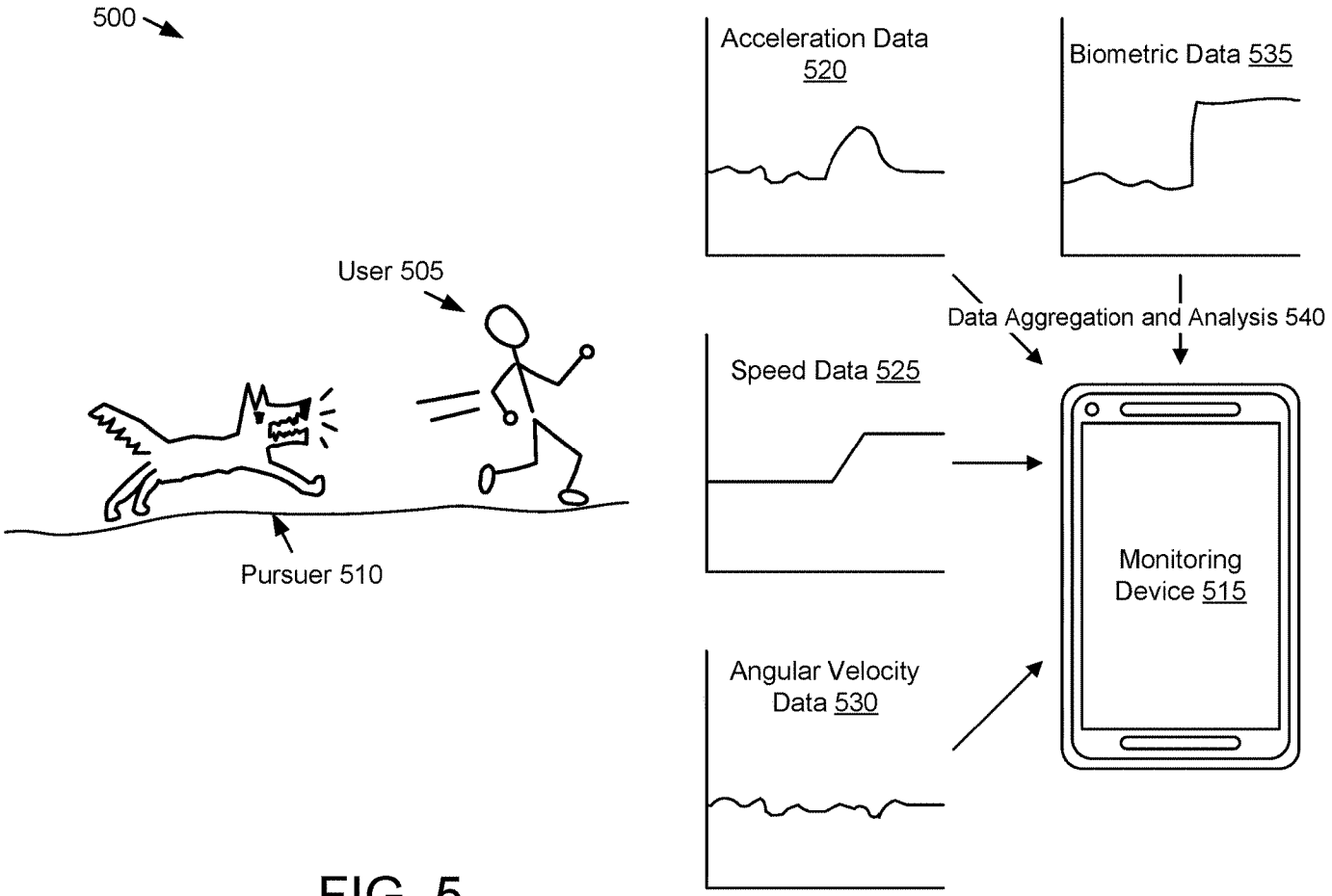
FIG. 5 is a schematic block diagram illustrating another example of determining user risk using multiple data types.

FIG. 5 depicts a second situation 500 of determining user risk using multiple data types, according to embodiments of the disclosure. In the second situation 500, a user 505 encounters a pursuer 510 which causes the user 505 to flee the area. A monitoring device 515 aggregates and analyzes various types of first data and detects the encounter with the pursuer 510. Here, the various types of first data collected and analyzed by the monitoring device 515 include acceleration data 520, speed data 525, angular velocity data 530, and biometric data 535.

The monitoring device 515 combines signals from various sensors in order to build a composite image what the user 505 is experiencing. In certain embodiments, the monitoring device 515 matches subsets of the acceleration data 520, speed data 525, angular velocity data 530, and biometric data 535 to various profiles in order to build the composite image. Here, the various profiles may be categorized as normal or abnormal, with abnormal profiles indicating an increased risk of the user being in danger.

At the point in time when the user 505 encounters the pursuer 510, various of the first data (such as the acceleration data 520) indicate a disruption to the normal pattern of motion of the user 505. Here, the specific data patterns may indicate the user beginning to sprint. Moreover, the speed data 525 confirms disruption to the user's pattern of motion and the biometric data 535 indicates that the user 505 is experiencing increased biological stress after the point in time when the user 505 encounters the pursuer 510. Here, the monitoring device 515 identifies, e.g., in real time, the various indicia of the user falling to the ground, which increase the probability of the user being in danger (e.g., to exceed a threshold value). At this point, the monitoring device 515 triggers acquisition of second data (and corresponding analysis) used to identify/confirm the user's situation.

As discussed above, the monitoring device 515 may acquire and analyze second data including geolocation data, audio data, and/or video data. Here, the audio and/or video data may be used to determine that the user 505 has encountered a pursuer 510 and is not engaged in a friendly competition. In certain embodiments, one or more analyses of the second data may be offloaded to a remote server. When the calculated probability of the person being in danger exceeds a certain threshold, the monitoring device 515 initiates one or more alarm responses, including automatic messaging of a designated contact, calling emergency services, etc. In one embodiment, the monitoring device 515 pick where the user 505 when the actuator probability exceeds the certain threshold. For example, the monitoring device 515 may ask "Are you in trouble?", "Do you need help?", or another phrase selected to verify that the user 505 requires assistance.

Figure 6:
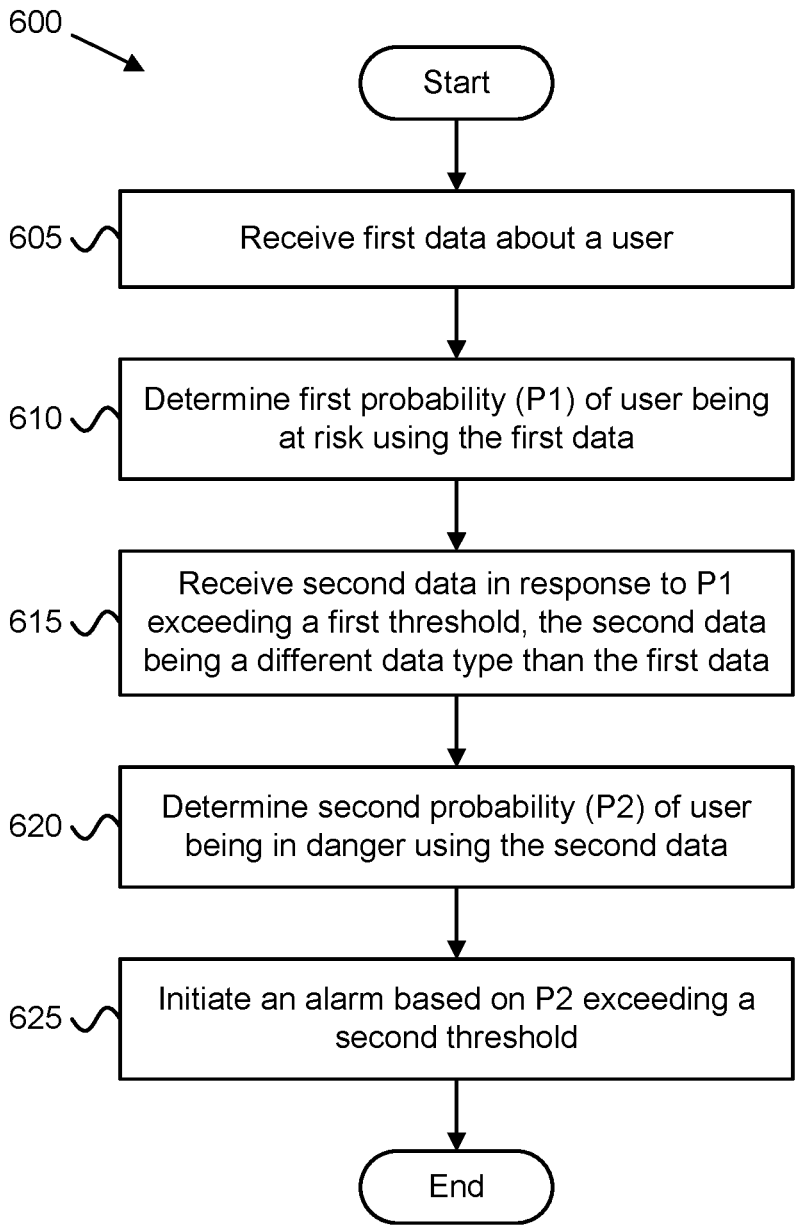
FIG. 6 is a schematic flow chart diagram illustrating one embodiment of a method for determining user risk using multiple data types.

FIG. 6 depicts a method 600 for determining user risk using multiple data types, according to embodiments of the disclosure. In certain embodiments, the method 600 is performed by the electronic device 105, the analysis module 135, the monitoring apparatus 200, by the detection device 415, and/or the monitoring device 515. Alternatively, the method 600 may be performed by a processor and a computer readable storage medium that is not a transitory signal. Here, the computer readable storage medium stores code that is executed on the processor to perform the functions of the method 600.

The method 600 begins and receives 605 first data about a user. In one embodiment, receiving 605 the first data includes receiving movement data of the user. In further embodiments, receiving 605 the first data further includes receiving biometric data of the user. In certain embodiments, receiving 605 the first data includes receiving data from an application running on the electronic device, such as a fitness activity application, a health monitoring application, a navigation application, or the like.

The method 600 includes determining 610 a first probability of the user being at risk using the first data. In one embodiment, determining 610 the first probability of the user being at risk using the first data includes calculating a degree to which a pattern of movement indicated by the movement data differs from a baseline pattern. In another embodiment, determining 610 the first probability of the user being at risk using the first data includes calculating whether the biometric data indicates a state of user stress.

The method 600 includes receiving 615 second data in response to the first probability exceeding a first threshold, the second data being a different type of data than the first data. For example, the first data may be movement data, step-counter data, and/or biometric data, while the second data may be location data, audio data, and/or image data. In certain embodiments, receiving 615 second data includes collecting additional first data.

The method 600 includes determining 620 a second probability of the user being in danger using the second data. In certain embodiments, determining 620 the second probability includes aggregating the various first and second data, optionally weighting the various data, and calculating the second probability using the aggregated data (optionally weighted).

Where receiving 615 the second data includes identifying a location of the user in response to the first probability exceeding a first threshold, then determining 620 the second probability may include increasing the probability of the user being in danger in response to the user being located in a higher risk geographic area. Where receiving 615 the second data includes capturing audio data, then determining 620 the second probability may include analyzing the audio data to determine whether the user speaks a predetermined phrase. Where receiving 615 the second data includes capturing both audio data and video data, then determining 620 the second probability of the user being in danger further may include analyzing the audio data and the image data for one or more of: an indication of a conflict, an indication of an injury, and an indication of damage.

The method 600 includes initiating 625 an alarm in response to the second probability exceeding a second threshold. In certain embodiments, initiating 625 the alarm includes contacting one of: a predetermined contact and a predetermined device. In further embodiments, initiating 625 the alarm further includes transmitting one or more of the second data and user location data to the predetermined contact or predetermined device. In some embodiments, initiating 625 the alarm also includes storing the second data to a remote storage device in response to the second probability exceeding the second threshold.

Figure 7:
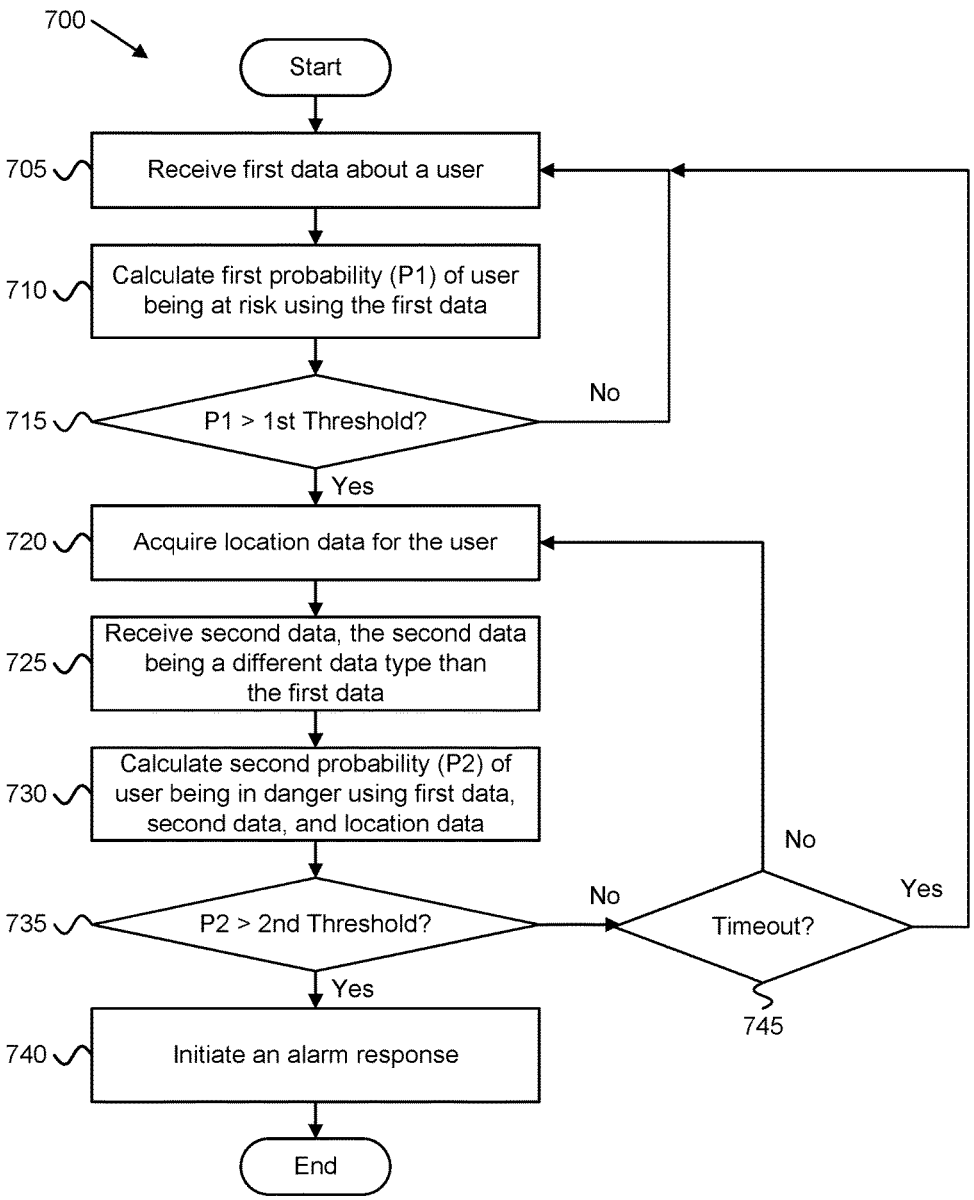
FIG. 7 is a schematic flow chart diagram illustrating another embodiment of a method for determining user risk using multiple data types.

FIG. 7 depicts a method 700 for determining user risk using multiple data types, according to embodiments of the disclosure. In certain embodiments, the method 700 is performed by the electronic device 105, the analysis module 135, the monitoring apparatus 200, by the detection device 415, and/or the monitoring device 515. Alternatively, the method 700 may be performed by a processor and a computer readable storage medium that is not a transitory signal. Here, the computer readable storage medium stores code that is executed on the processor to perform the functions of the method 700.

The method 700 begins and receives 705 first data about a user. In one embodiment, receiving 605 the first data includes receiving movement data and/or biometric data of the user. In certain embodiments, receiving 705 the first data includes receiving data from an application running on the electronic device, such as a fitness activity application, a health monitoring application, or the like. In some embodiments, receiving 705 the first data includes receiving movement data and/or biometric data from a wearable device worn by the user.

The method 700 includes calculating 710 a first probability ($P_1$) of the user being at risk using the first data. In one embodiment, calculating 710 the first probability of the user being at risk using the first data includes calculating a degree to which a pattern of movement indicated by the movement data differs from a baseline pattern. In another embodiment, calculating 710 the first probability of the user being in a risk situation using the first data includes calculating the likelihood of the user being in a state of stress based on received biometric data.

The method 700 also includes determining 715 whether the first probability (e.g., at the user being in a risk situation) exceeds the first threshold. Here, the first threshold corresponds to a strong likelihood of the user being in the risk situation. If the first probability does not exceed the first threshold, then the method 700 continues to receive 705 (additional) first data about the user and re-calculate 710 the first probability using (additionally received) first data. Otherwise, the method 700 includes acquiring 720 location data for the user in response to the first probability exceeding the first threshold.

Acquiring 720 the location data for the user may include receiving coordinates corresponding to the user's location, such as satellite navigation coordinates. In certain embodiments, acquiring 720 the location data may include determining whether the coordinates correspond to an area of higher risk, is an area with a higher crime rate, an area near a recently reported crime, an area with a higher accident rate, and/or an area near a recently reported accident. Where the user is located within an area of higher risk, there is a higher likelihood of the detected risk situation corresponding to the user being in danger.

Additionally, the method 700 includes receiving 725 second data in response to the first probability exceeding the first threshold. Here, the second data corresponds to different types of data than those in the first data. For example, the first data may be movement data and/or biometric data, while the second data may be audio data and/or image data. In certain embodiments, receiving 725 second data includes collecting additional first data. In one embodiment, receiving 725 the second data includes gathering second data by activating one or more sensors or data sources.

The method 700 includes calculating 730 a second probability of the user being in danger using the second data, the (additional) first data, and the location data. In certain embodiments, calculating 730 the second probability includes aggregating the various first and second data, weighting the various data, and calculating the second probability using the aggregated data. Moreover, when the user is located within an area of higher risk, there is a higher likelihood of the detected risk situation corresponding to the user being in danger.

Where receiving 725 the second data includes capturing audio data, then calculating 730 the second probability may include analyzing the audio data to determine whether the user speaks a predetermined phrase. Where receiving 725 the second data includes capturing both audio data and video data, then calculating 730 the second probability of the user being in danger further may include analyzing the audio data and the image data for one or more of: an indication of a conflict, an indication of an injury, and an indication of damage.

The method 700 includes determining 735 whether the second probability exceeds a second threshold. In certain embodiments, the second threshold is a different value than the first threshold. In other embodiments, the two thresholds may be the same value. If the second probability exceeds the second threshold, the method 700 initiates 740 an alarm response. Otherwise, if the second probability does not exceed the second threshold, the method 700 determines 745 whether predetermined amount of time has passed since the first probability exceeded the first threshold. If the predetermined amount of time has passed (e.g., a timeout has occurred), then the method 700 returns to receiving 705 (additional) first data about the user and re-calculating 710 the first probability using the (additionally received) first data. Otherwise, if no timeout occurs, the method 700 continues to acquire 720 location data for the user, receive 725 second data, and (re-) calculate 730 the second probability.

Initiating 740 the alarm response in response to the second probability exceeding the second threshold may include contacting one of: a predetermined contact and a predetermined device. In certain embodiments, initiating 740 the alarm response may include transmitting one or more of the second data and user location data to the predetermined contact or predetermined device. In some embodiments, initiating 740 the alarm also includes storing the second data to a remote storage device in response to the second probability exceeding the second threshold.

Embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a processor;

a memory that stores code executable by the processor to:

receive first data about a user;

determine a first probability of the user being at risk using the first data, the first data comprising at least one of: movement data and biometric data;

activate one or more additional sensors in response to the first probability of the user being at risk exceeding a first threshold;

gather second data about the user from a second set of sensors, the second set comprising the activated one or more additional sensors, the second data being a different type of data than the first data, wherein gathering the second data is triggered by the first probability of the user being at risk exceeding a first threshold;

determine a second probability of the user being at risk using at least the second data; and initiate an alarm in response to the second probability of the user being at risk exceeding a second threshold.

2. The apparatus of claim 1, wherein the processor further stores the second data to a remote storage device in response to the second probability of the user being at risk exceeding the second threshold.

3. The apparatus of claim 1, wherein the processor further identifies a location of the user in response to the first probability exceeding a first threshold, wherein determining the second probability comprises increasing the second probability of the user being in danger in response to the user being located in a higher risk geographic area.

4. The apparatus of claim 1, wherein receiving the first data comprises receiving movement data of the user and wherein determining a first probability of the user being at risk using the first data comprises calculating a degree to which a pattern of movement indicated by the movement data differs from a baseline pattern.

5. The apparatus of claim 1, wherein receiving the first data comprises receiving biometric data of the user and wherein determining a first probability of the user being at risk using the first data comprises calculating whether the biometric data indicates a state of user stress.

6. The apparatus of claim 1, wherein receiving the second data comprises capturing audio data, and wherein determining the second probability of the user being in danger comprises analyzing the audio data to determine whether the user speaks a predetermined phrase.

7. The apparatus of claim 1, wherein receiving the second data comprises capturing image data, and wherein determining the second probability of the user being in danger comprises analyzing the image data for one or more of: an indication of a conflict, an indication of an injury, and an indication of damage.

8. The apparatus of claim 1, wherein initiating the alarm comprises contacting one of: a predetermined contact and a predetermined device.

9. A method comprising:

receiving, by use of a processor, first data about a user;

determining a first probability of the user being at risk using the first data, the first data comprising at least one of: movement data and biometric data;

activating one or more sensors in response to the first probability exceeding a first threshold;

collecting second data about the user using the activated one or more sensors, the second data being a different type of data than the first data;

determining a second probability of the user being in danger based on at least the second data; and initiating an alarm based on the second probability exceeding a second threshold.

10. The method of claim 9, further comprising storing the second data to a remote storage device in response to the second probability exceeding the second threshold.

11. The method of claim 9, further comprising identifying a location of the user in response to the first probability exceeding a first threshold, wherein determining the second probability comprises increasing the second probability of the user being in danger in response to the user being located in a higher risk geographic area.

12. The method of claim 9, wherein receiving the first data comprises receiving movement data of the user and wherein determining the first probability of the user being at risk using the first data comprises calculating a degree to which a pattern of movement indicated by the movement data differs from a baseline pattern.

13. The method of claim 12, wherein receiving the first data further comprises receiving biometric data of the user and wherein determining the first probability of the user being at risk using the first data comprises calculating whether the biometric data indicates a state of user stress.

14. The method of claim 9, wherein receiving the second data comprises capturing audio data, and wherein determining the second probability of the user being in danger comprises analyzing the audio data to determine whether the user speaks a predetermined phrase.

15. The method of claim 14, wherein receiving the second data further comprises capturing image data, and wherein determining the second probability of the user being in danger further comprises analyzing the audio data and the image data for one or more of: an indication of a conflict, an indication of an injury, and an indication of damage.

16. The method of claim 9, wherein initiating the alarm comprises contacting one of: a predetermined contact and a predetermined device.

17. The method of claim 16, wherein initiating the alarm further comprises transmitting one or more of the second data and user location data to the predetermined contact or predetermined device.

18. A program product comprising a computer readable storage medium that stores code executable by a processor, the executable code comprising code to:

receive first data about a user, the first data comprising data collected by a first set of data sources;

determine a first probability of the user being at risk using the first data;

activate one or more sensors from a second set of data sources in response to the first probability of the user being at risk exceeding a first threshold;

receive second data about the user from the activated one or more sensors, the second data being a different type of data than the first data;

determine a second probability of the user being at risk using the second data; and initiate an alarm in response to the second probability of the user being at risk exceeding a second threshold.

19. The program product of claim 18, wherein receiving the first data comprises receiving one or more of: movement data of the user and biometric data of the user; and wherein receiving the second data comprises receiving one or more of: video data, audio data, and location data.

20. The program product of claim 18, wherein initiating the alarm comprises sending the second data to one of: a predetermined contact and a predetermined device.

* * * * *